United States Patent [19]

DeMayo

[11] 4,023,527

[45] May 17, 1977

[54] POWDERED TONER DEVELOPING SYSTEM IN XEROGRAPHIC REPRODUCING APPARATUS

[75] Inventor: John F. DeMayo, Oyster Bay, N.Y.

[73] Assignee: Sensonics, Inc., Hicksville, N.Y.

[22] Filed: Feb. 27, 1976

[21] Appl. No.: 662,039

Related U.S. Application Data

[63] Continuation-in-part of Ser. No. 521,537, Nov. 6, 1974, abandoned, which is a continuation-in-part of Ser. No. 411,737, Nov. 1, 1973, Pat. No. 3,863,114.

[52] U.S. Cl. ..... 118/655; 259/1 R; 259/47; 222/DIG. .001

[51] Int. Cl.[2] ..... G03G 13/08; B01F 11/00

[58] Field of Search ..... 259/1 R, 27, 47, 42, 259/113, DIG. 41, 42; 222/DIG. .001, 200, 244, 234, 243, 193, 198, 196, 409; 118/637

[56] References Cited

UNITED STATES PATENTS

| | | | |
|---|---|---|---|
| 1,932,520 | 10/1933 | Horsch | 193/2 B |
| 1,986,038 | 1/1935 | Zielke | 259/DIG. .041 |
| 2,458,313 | 1/1949 | Stevens | 259/DIG. .041 |
| 3,013,703 | 12/1961 | Hunt | 222/409 |
| 3,133,833 | 5/1964 | Giamo, Jr. | 118/637 |
| 3,300,101 | 1/1967 | Wagner | 222/DIG. .001 |

*Primary Examiner*—Stanley H. Tollberg
*Assistant Examiner*—N. L. Stack, Jr.
*Attorney, Agent, or Firm*—Robert E. Burns; Emmanuel J. Lobato; Bruce L. Adams

[57] ABSTRACT

In xerographic reproducing apparatus using dry powdered toner, means is provided for applying a series of periodic mechanical tapping impulses to the toner dispenser to promote uniformity of toner dispensing and obtain clearer, sharper copies. The tapping means comprises a base affixed to the toner dispenser, a movable hammer for striking the base and electromagnetic means for periodically actuating the hammer to strike the base and thereby generate periodic mechanical tapping impulses which are conductively transmitted to the toner dispenser.

19 Claims, 9 Drawing Figures

POWDERED TONER DEVELOPING SYSTEM IN XEROGRAPHIC REPRODUCING APPARATUS

This application is a continuation-in-part of my application Ser. No. 521,537 filed Nov. 6,1974 now abandoned which is a continuation-in-part of my application Ser. No. 411,737 filed Nov. 1, 1973 and now U.S. Pat. No. 3,863,114.

FIELD OF THE INVENTION

The present invention relates to dispensing powdered toner in xerographic reproducing apparatus.

BACKGROUND OF INVENTION

In the process of xerography as disclosed for example in Carlson U.S. Pat. No. 2,297,691, a latent electrostatic image of the material to be reproduced is formed on a xerographic plate. Development of the image on the plate is effected by a toner comprising a suitable pigmented or dyed electrostatic powder carried on a granular material which functions to provide mechanical control of the powder and to carry the powder to the image surface. The granular material carrying the toner is transported from a suitable reservoir to the xerographic plate and allowed to flow down over the plate. As the powder coated carrier particles roll or tumble down over the xerographic plate carrying a latent electrostatic image, toner particles are pulled away from the carrier by the charged latent image and deposit on the plate to form a powder image while the partially denuded carrier particles pass off of the plate and are returned to the reservoir.

In order to replenish the toner particles on the carrier material, additional toner particles must be supplied to the developer mixture in proportion to the amount of toner deposited on the plate. Accordingly, toner dispensing means must be provided for supplying toner in the correct amount. If insufficient toner is supplied, the prints produced by the apparatus have low contrast images. If on the other hand too much toner is supplied, the background of the copies produced may have a gray or muddy appearance. Thus, in order continually to obtain prints of good quality, the quantity of toner powder in the developer mixture must be held reasonably constant by the addition of toner to the developer mixture in proportion to the amount of toner used up.

As the toner is a very fine electrostatic powder it is difficult to handle and to dispense uniformly in a precisely controlled amount. The powder tends to agglomerate and cake so that it does not flow uniformly in proper amount from the dispenser. Apparatus has heretofore been provided with a small paddle or stirrer for manually stirring the toner in the dispenser from time to time in order to break up any caking. However, because of the black and adhesive nature of the toner this is a very messy operation.

SUMMARY OF INVENTION

It is an object of the present invention to improve the dispensing of toner and its transport to the plate in xerographic apparatus so as to assure that copies of uniformly good quality are continually obtained.

In accordance with the invention means is provided for applying a series of periodic mechanical impulses to the toner dispenser to promote uniformity of the amount and distribution of the toner dispensed and thereby assure clear, sharp copies. The means for generating the periodic mechanical impulses preferably comprises a base affixed to the toner dispenser or associated part of the apparatus, an anvil on the base, a movable hammer for stiking the anvil and electromagnetic means for periodically actuating the hammer to strike the anvil and thereby generate periodic mechanical tapping impulses which are conductively transmitted to the toner dispenser and associated parts of the image developing system. The periodic mechanical impulses preferably have a frequency of about 50 to 60 cycles per second. While the theory of operation of apparatus in accordance with the invention, insofar as its total effect on the copies is concerned, is not as yet fully understood, it has been found that the quality and uniformity of the copies produced are markedly improved.

BRIEF DESCRIPTION OF DRAWINGS:

The nature, objects and advantages of the invention will be more fully understood from the following description of apparatus shown by way of example in the accompanying drawings in which.

Figure 1:
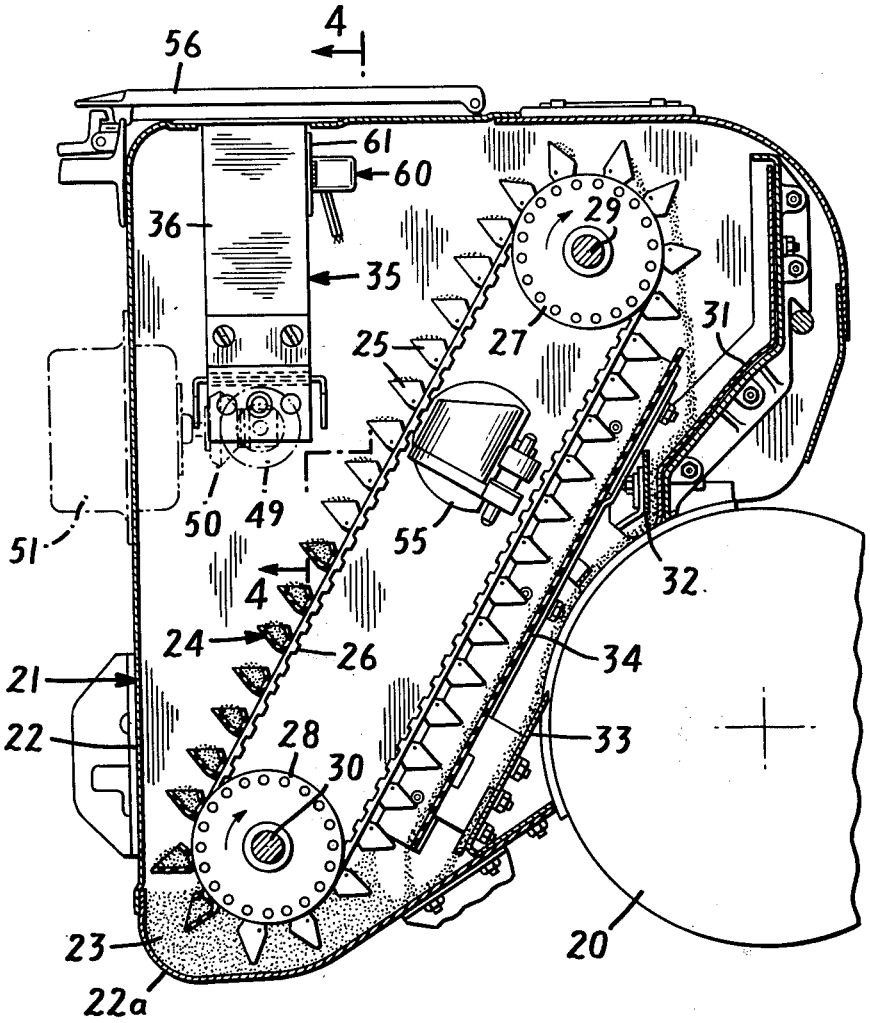
FIG. 1 is a partial cross section of xerographic apparatus embodying the invention.

DESCRIPTION OF PREFERRED EMBODIMENT:

As the process of xerography is well known, for example from Carlson U.S. Pat. No. 2,297,691 only the xerographic plate in the form of a rotatable cylinder 20 and developer apparatus 21 are illustrated in FIG. 1. The developer apparatus comprises a housing 22, a lower portion **22*a* of which forms a reservoir for a developing mixture 23.** The developing mixture comprises a suitable pigmented or dyed electrostatic powder and a granular carrier material which functions to carry the toner powder to the xerographic plate. The toner powder is many times finer than the granular carier material. A suitable two component developing material is disclosed in Walkup U.S. Pat. No. 2,638,416.

A suitable conveyor 24 is provided for transporting the developer material from the reservoir **22*a* and distributing it over the drum 20. The conveyor is illustrated as comprising a plurality of elongate trough like buckets 25 carried by endless belts 26 running on pulleys 27 and 28 on shafts 29 and 30. One of the shafts is driven by a motor (not shown) to rotate the pulleys in a clockwise direction so that the buckets 24 scoop up developer material 23 from the reservoir 22***a*, carry it upwardly over the upper pulleys and discharge it down onto the drum 20. Plates 31 and 32 guide the material and directed it onto the drum. As the buckets 24 extend the full length of the drum, the toner material is distributed over the full length of the drum surface. As the granular carrier material slides or rolls down over the drum surface the toner powder carried by the granular material is electrostatically attracted to charged portions of the surface of the drum 20 and adhere to the surface in the pattern of the latent electrostatic image which has been formed on the drum. The granular carrier material with the remaining toner is guided back to the reservoir 22*a* by a guide plate 33. Any developer material which was not discharged onto the drum is returned to the reservoir by a guide plate 34. The developer apparatus is described more fully in Lewis U.S. Pat. No. 3,067,720 and Kamola U.S. Pat. No. 3,682,132.

As the toner component is continually used up to form on the xerographic drum 20 images which are then transferred to the paper or other copy medium, it is necessary to replenish the toner component of the developer material. For this purpose a toner dispenser 35 is provided for discharging toner powder into the developer material supply system comprising the reservoir 22*a* and conveyor 24. The toner dispenser is illustrated by way of example in FIGS. 1, 3 and 4 as comprising a hopper 36 having opposite side walls 37 and opposite end walls 38. Upper portions of the walls are flanged as indicated at 36*a* to provide support for the hopper. A dispensing plate 39 forms the bottom of the hopper but is spaced slightly below the lower edges of the side walls 37 to leave a small gap 40 at each side of the hopper. The slots 40 constitute discharge passageways for flow of toner powder from the dispenser.

The flow of toner particles through the outlets 40 is controlled by a metering element 41 comprising a dispensing grid 42 positioned for reciprocating motion in the space between the dispensing platform 39 and the lower edges of the walls of the hopper. The metering element 41 has side flanges 43 to the ends of which end plates 44 are affixed. Guide rods 45 extending through bearings in the end plates 44 support and guide the metering element 41 for reciprocatory movement in a lengthwise direction. The guide rods 45 are supported by bearing blocks 46 and 47 affixed to opposite ends of the hopper.

Figure 4:
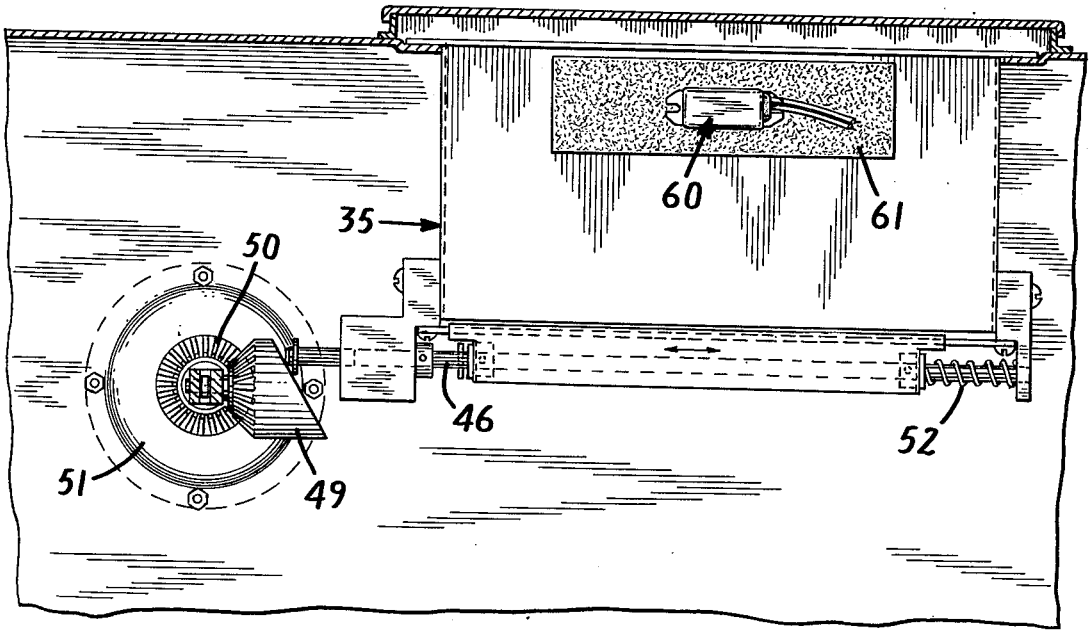
FIG. 4 is a side view of the toner dispenser together with actuating mechanism.

Stepwise reciprocatory movement of the metering element 41 is effected by a plunger 48 which is slidable in the guide block 47 and bears against one of the end plates 44. The plunger 48 is actuated by a cam 49 (FIG. 4) driven through bevel gears 50 by a motor 51. Return movement of the metering element toward the left as viewed in FIG. 4 is effected by springs 52 on the guide rods 46. During operation of the machine the cam 49 is rotated preferably in an intermittent manner by the motor 51 so as to move the metering element stepwise toward the right as viewed in FIG. 4 and then by continued rotation of the cam to permit movement of the metering element toward the left by the springs 52. This movement of the metering element is intended to cause toner to be discharged from the hopper 36 in a controlled amount. The toner powder falls down onto the conveyor 24 and into the reservoir 22*a* to replenish the toner component of the composite developer material. A suitable toner dispenser is more fully described in Hunt U.S. Pat. No. 3,013,703 and Mayo et al U.S. Pat. No. 3,062,109.

The amount of toner supplied by the dispenser 36 can be suitably controlled by varying the movement of the metering element 41 for example by varying the frequency with which it is moved or the distance it is moved in each step. Such control can be effected automatically under control of a sensing device 55 (FIG. 1) as more fully disclosed in Kamola U.S. Pat. No. 3,682,132. Alternatively the rate at which toner powder is dispensed can be controlled manually. An opening closed by a hinged lid 56 is provided in the top of the housing 22 for the purpose of filling the toner dispenser.

In accordance with the present invention the operation of the developer system is improved by applying a series of periodic mechanical tapping impulses to the toner dispenser or associated structure of the developing apparatus. The impulses are generated by means of a tapping device 60 which is illustrated by way of example as being affixed to one of the side walls of the toner dispenser 35. A suitable tapping device is shown by way of example in FIGS. 5 and 6. For clarity of illustration these drawings are greatly enlarged. The actual tapping device is quite small being for example three centimeters by two centimeters by 1.5 centimeter.

The tapping device is shown as comprising a frame 1 having a base portion 2. An anvil 3 projects upwardly at one side of the base and two parallel posts 4*a* and 4*b* project upwardly at the opposite side of the base. The entire frame including the base, anvil and posts is preferably of integral construction and is conveniently made as a metal stamping of ferromagnetic sheet metal. To facilitate mounting the tapping device on the hopper or other surface, the frame 1 is mounted on a subbase 5 having projecting end portions 5*a* provided with holes or notches 5*b* for the reception of screws or other securing means. While the frame 1 and subbase 5, can if desired be suitably secured together, for example by welding or adhesive, this is generally not necessary as they are held together by assembly of the magnet on the frame and subbase as described below.

Figure 5:
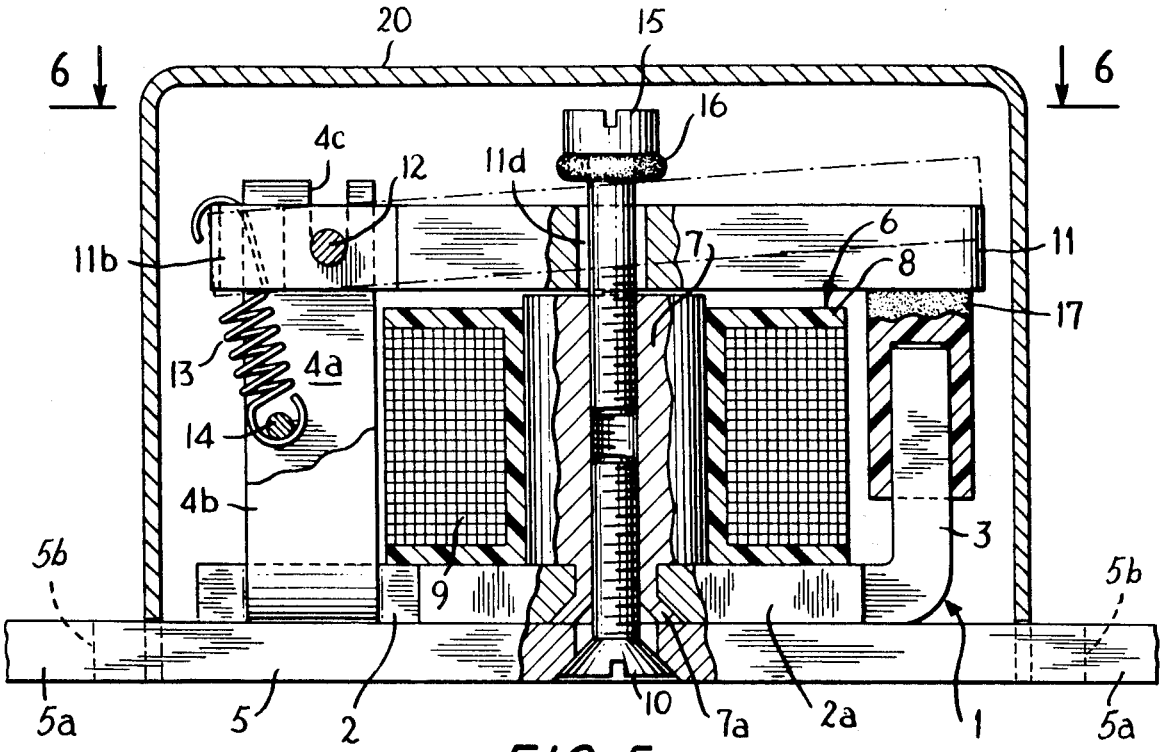
FIG. 5 is an enlarged longitudinal section showing an example of tapping means in accordance with the invention.

An electromagnet 6 positioned on the portion 2 between the anvil 3 and the posts 4*a* and 4*b* comprises a generally cylindrical core 7 of ferromagnetic material and a coil which surrounds the core and comprises an annular plastic oil form 8 and winding 9. The core 7 has a tubular end portion 7*a* which extends through a chamfered hole in the base 2 and is peened over as seen in FIG. 5 so as to secure the core to the base. A screw 10 extending through a counter-sunk hole in the subbase 5 and screwed into a tapped hole in the core secures the frame with the electromagnetic assembly to the subbase 5.

Figure 6:
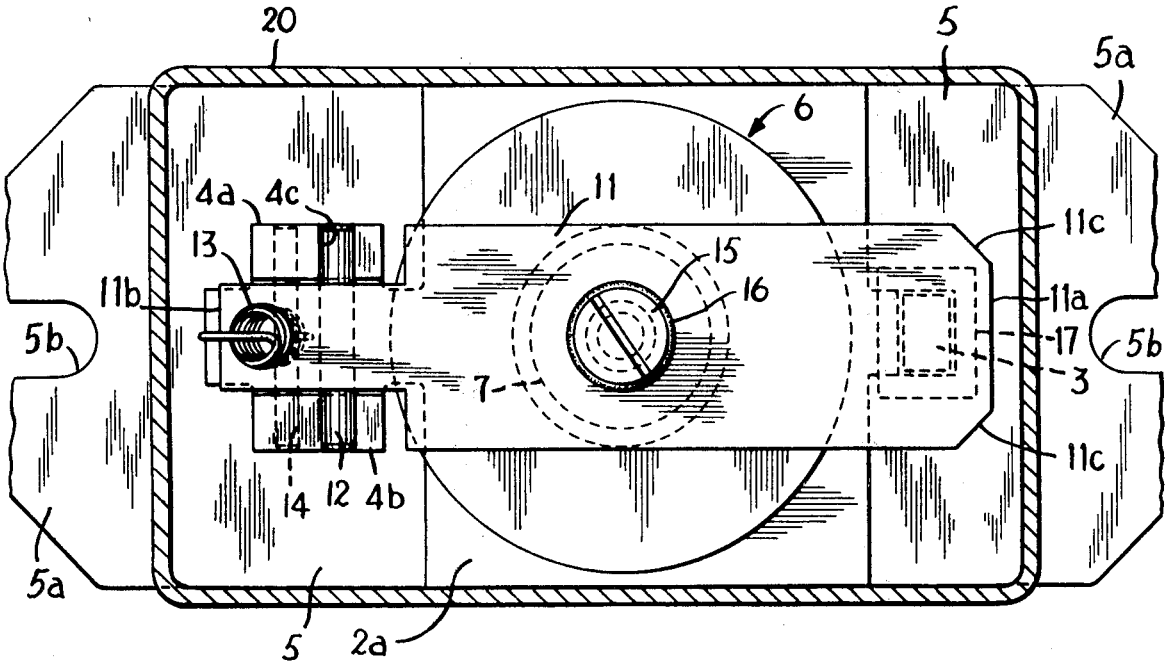
FIG. 6 is a cross section taken approximately on the line 6—6 of FIG. 5.

An armature 11 of ferromagnetic material extends diametrically over the upper end of the electromagnet and has at one end a hammer portion 11*a* disposed above the anvil 3 while the opposite end 11*b* is of reduced width and is received between upper end portions of the posts 4*a* and 4*b*. A pivot pin 12 extends through aligned holes or slits 4*c* in the posts and a hole in the reduced end portion 11*b* of the armature to provide a pivotal mounting of the armature for movement toward and away from the electromagnet and the anvil. As seen in FIG. 6 the armature 11 is of generally rectangular shape except for the reduced end portion 11*b* and chamfered corners 11*c*. As illustrated in FIG. 5 the armature 11 is movable about its pivot between a lower position approximately parallel to the base as shown in solid lines and an upper inclined position as shown in broken lines. The armature is biased to the uper position by a tension spring 13 acting between the reduced end portion 11*b* of the armature and a pin 14. Upward movement of the armature is limited by a screw 15 which extends through a hole 11*d* in the armature and is screwed into a tapped hole in the core 7. An O-ring 16 of elastomeric material fits over the shank of the screw 15 below the head and prevents metal-to-metal contact of the armature with the head of the screw. Alternatively, the screw 15 can be nylon in which event an O-ring is not needed. By screwing the screw 15 a greater or lesser distance in the tapped hole in the core, the amplitude of movement of the hammer portion 11*a* of the armature and hence the impact of the hammer portion on the anvil can be adjusted as desired.

When the electromagnet is energized the armature 11 is pulled down against the action of the spring 13 so as to cause the hammer portion 11*a* to strike the anvil 3. However, in order to avoid metal-to-metal impact between the hammer portion of the armature and the anvil, a nonmetallic bumper 17 is provided between them. The bumper is sufficiently hard to generate a strong mechanical pulse when the hammer portion of the armature strikes the anvil while at the same time avoiding excessive noise. It is preferably formed of durable, impact resistant elastomeric material having a durometer of the order of fifty to seventy. It has been found desirable to adjust the screw 15 and to select other parameters including the weight of the hammer portion 11*a* and the thickness and material of the bumper 17 to provide an impulse having a value between 1*g*. and 4*g*. The value of the impulse is conveniently measured by mounting the tapping device on a 2 pound brass block supported by soft foam and measuring acceleration of the block by an accelerometer.

In FIG. 1 the bumper 17 is shown as being in the form of a cap which fits over the upper end of the anvil. Alternatively, it may be in the form of a round or rectangular pad which is adhesively secured to the lower face of the hammer portion 11*a* of the armature and has an area greater than that of the upper end of the anvil. In either event the thickness of the bumper material between the armature and the metallic portion of the anvil is sufficient to provide suitable bumper effect and avoid rapid cutting or wear of the bumper material while reducing audible noise. For example, it may be of a thickness of the order of 0.05 inch.

The tapping unit is enclosed in a cup-shaped cover 20 which is shown as being of rectangular configuration. The cover fits over the unit and is suitably retained for example by soldering or adhesive. The cover is formed of any suitable material, for example aluminium or plastic.

The subbase 5 of the tapping unit is suitably affixed to the hopper of the dispenser or other associated structure of the developer system, for example by screws extending through the notches 5*b* of the subbase. Alternatively, as illustrated by way of example in the drawings, the tapping unit is mounted by means of magnetic tape 61 which is coated on one side with pressure sensitive adhesive. The adhesive side of the tape is pressed onto the surface on which the tapping unit is to be mounted. The tapping unit is then placed on the magnetic tape and is held by magnetic attraction. A further means for attaching the tapping unit is double sided adhesive tape.

Figure 2:
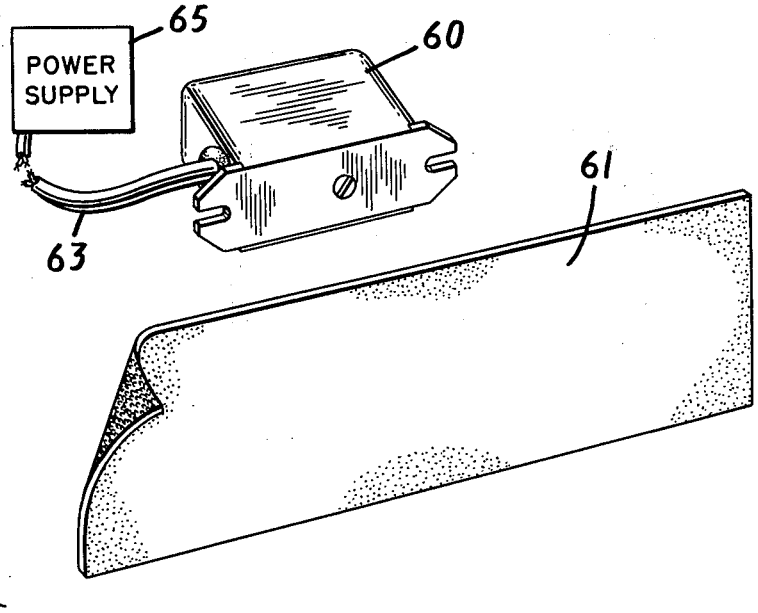
FIG. 2 is an exploded perspective view of tapping means for generating periodic mechanical tapping impulses and of adhesive magnetic tape for affixing the tapping means to the toner dispenser of the apparatus.

The electromagnet of the tapping unit is provided with leads 63 by which it is connected to a suitable power supply 65 indicated schematically in FIG. 2. The power supply comprises for example a half wave rectifier fed from a suitable 115 volt or 230 volt, 60 or 50 cycle supply line. The rectifier is preferably a suitable solid state rectifier having a low resistance in one direction and a very high resistance in the opposite direction. By reason of the half wave rectification of the alternating power supply, the voltage is applied to the electromagnet for approximately half of each cycle of the alternating current source. During the other half cycle the magnet is deenergized so as to release the armature. Other suitable power supplies for periodically energizing the magnet can be provided as desired.

As the power consumption of the tapping device is very small, for example about one and a half watts, it can be left on during the time the xerographic apparatus is turned on for service. Alternatively, the tapping device can be connected in circuit with one of the motors of the apparatus, for example the dispenser motor 51 of the motor driving the conveyor 24 so that the tapping device operates only during the time that a copy is being made. If it is not desired to connect the tapping device in circuit with the xerographic apparatus, it can be conveniently controlled by a separate manually operated switch.

A tapping device of the kind illustrated in FIGS. 5 and 6 and also an alternative form of the tapping device are described more fully in the above mentioned application Ser. No. 411,737, now U.S. Pat. No. 3,863,114.

Figure 7:
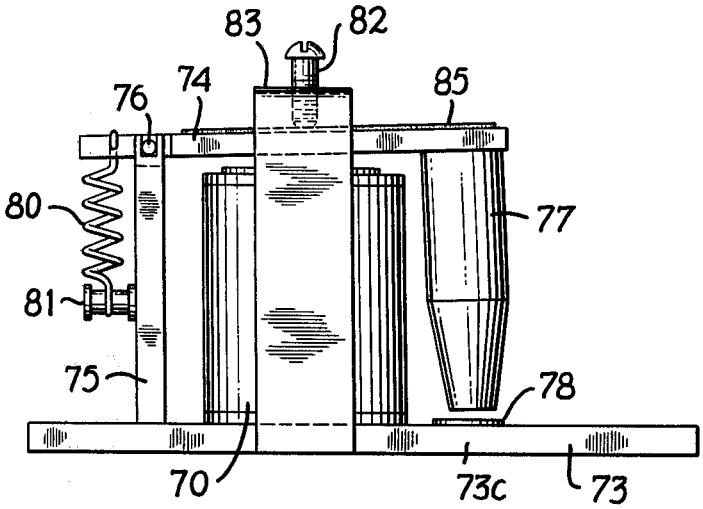
FIG. 7 is an enlarged side view of another example of tapping means in accordance with the invention with the cover removed.
Figure 8A:
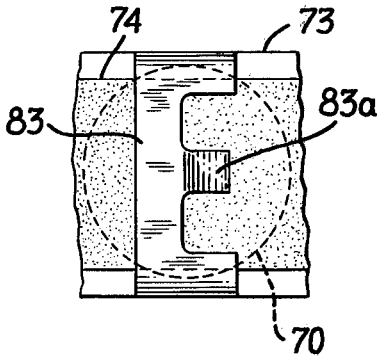
FIG. 8A is a fragmentary view showing a modification.
Figure 8:
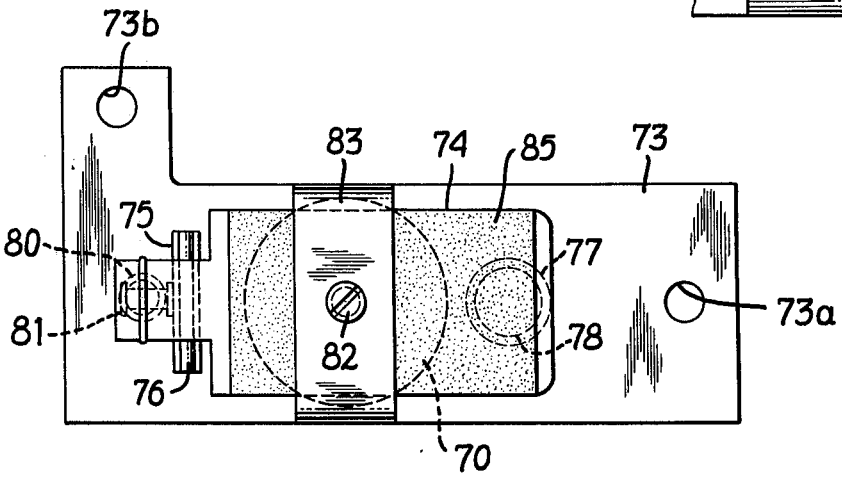
FIG. 8 is a top view of the tapping means shown in FIG. 7.

In FIGS, 7 and 8 there is shown a further embodiment of a tapping device in which an electromagnet 70 comprising a core piece surrounded by an annular coil is mounted on a base plate 73 having holes 73*a* and 73*b* to receive screws or bolts for securing the tapping device to the hopper of the dispenser or other associated structure of the developer system on which the tapping device is to be mounted. An armature 74 is pivotally mounted near one end on a support 75 projecting up from the base. The pivot comprises a pin 76 extending through and projecting laterally from the armature and having portions received in notches at the upper end of the support 75. A hammer portion 77 on the opposite end of the armature 74 is adapted to strike a pad 78 of nonmetallic material secured on or recessed in the upper surface of an anvil portion 73*c* of the base plate 73. As in the case of the bumper 17 of the embodiment illustrated in FIGS. 5 and 6, the pad 78 is of a selected material and thickness to be durable and impact resistant and to avoid excessive noise while providing an impulse of selected magnitude, for example 1*g*. to 4*g*. when struck by the hammer 77. Return movement of the armature is provided by a tension spring 80 extending between a stud 81 on the support 75 and a projecting end portion of the armature 74. Upward movement of the armature is limited by a small stud bolt 82 screwed through a threaded opening in a U-shaped bracket 83 which extends up over the electromagnet and the armature and has its lower ends secured to opposite sides of the base plate 73. The screw 82 provides means for adjusting the amplitude of movement of the hammer 77 and hence the force with which it strikes the pad 78 on the anvil portion of the base plate 73. Alternatively, as illustrated in FIG. 8A, the horizontal portion of the bracket 83 is provided with a tab 83*a* which is bent down a selected amount to provide the desired adjustment. A layer of rubber or plastic material 85 on the upper face of the armature 74 prevents metal-to-metal contact between the armature and the lower end of the stud 82. As in the case of the tapping device of FIGS. 5 and 6, the electromagnet is connected to a suitable power supply for periodically energizing the electromagnet and thereby causing the hammer 77 to strike the pad 78 on the anvil portion of the base 83 to produce a mechanical impulse which is transmitted to the toner dispenser and other associated structure of the developer system on which the tapping device is mounted. The power supply preferably includes suitable switch means for turning it on when the xerographic apparatus is in operation. The operation of the tapping device shown in FIGS. 7 and 8 is the same as has already been described. Still other embodiments of tapping devices are disclosed in my U.S. Pat. No. 3,507,339.

Figure 3:
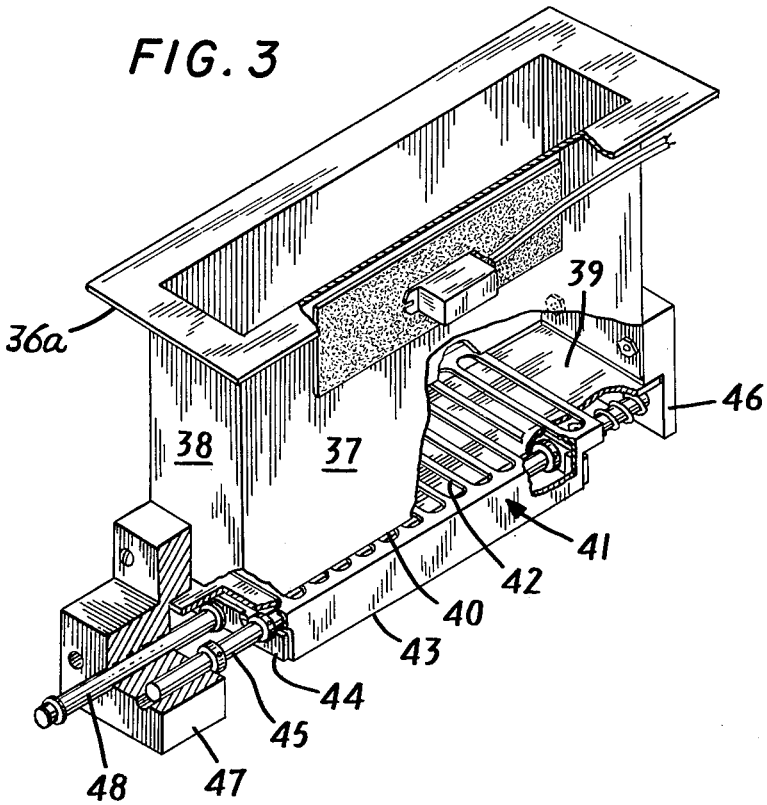
FIG. 3 is a perspective view of the toner dispenser with portions broken away to show a part of the interior.

While the theory of the manner in which the impulse generating device affects the operation of the xerographic developing apparatus is not at present fully understood, it has been found that uniformly clearer and sharper copies are obtained when the device is in use. It is believed that the periodic mechanical impulses which are generated by the device assist in preventing undesired caking, bridging or agglomeration of the toner in the dispenser and assist in the uniform removal of toner from the edges of the dispensing plate 39 after it passes through the discharge openings of the dispensing unit. Moreover, it appears that the periodic mechanical impulses imparted to the dispensing unit promote uniformity of toner dispensing and uniform distribution throughout the length of the dispenser. When the impulse generating device is mounted on the hopper of the toner dispenser it has been found desirable to affix the impulse generating device to theside of the hopper as illustrated in FIGS. 3 and 4 so that the mechanical impulses generated by the device are applied to the hopper in a horizontal direction approximately perpendicular to the direction of movement of the metering element 41 of the dispenser.

It further appears that the mechanical impulses generated by the impulse generating device are transmitted to the reservoir 22*a* and the conveying system 24 and may have the effect of improving distribution of the toner powder on the granules of the carrier material and of increasing the capacity of the carrier material to hold toner powder. Moreover, it has been found that the effective useful life of the carrier material is increased. Whereas the companies that manufacture and service the xerographic developing apparatus recommend replacement of the carrier material after a stated number of copies have been made by the apparatus, it has been found that when an impulse generating device is applied to the developer system in accordance with the present invention, the carrier material can be used much longer and still produces excellent copies. There may be still other effects which have not as yet been ascertained. However, the results achieved are readily apparent. While it is presently thought that the impulse generating device is best mounted on the toner dispenser 35, it can if desired be mounted on other portions of the xerographic developing apparatus since all of the structure is interconnected so that mechanical impulses applied to one portion are conductively transmitted to other portions of the structure.

While the impulse generating device has been shown as being applied to one particular form of xerographic apparatus as illustrated in the drawings, it will be understood that this is only by way of example and that the invention is likewise applicable to other xerographic apparatus using powdered toner. The invention is thus in no way limited to the particular structure shown by way of example in the drawings.

What I claim and desire to secure by letters patent is:

1. In xerographic reproduction apparatus, the combination of a xerographic plate, means for supplying powdered toner to said plate comprising a housing, a developer reservoir in said housing, said reservoir containing in a lower portion thereof a developer comprising granular carrier material with powdered toner thereon, means for transporting said granular carrier material with said toner thereon from said reservoir to said plate to which a portion of the toner adhers to form an image, means for returning the granular carrier material and remaining toner to said reservoir, means for intermittently dispensing toner to said reservoir to replenish the toner on said carrier material in said reservoir and transport means, said toner dispensing means comprising a container for toner and metering means controlling the amount of toner intermittently dispensed from said container to said reservoir, tapping means for generating periodic mechanicaltapping impulses comprising a base, an electromagnet disposed on said base and comprising a ferromagnetic core normal to the base and a winding around said core, anvil means on said base at one side of said electromagnet, armature supporting means projecting from said base at the opposite side of said electromagnet from said anvil means, an armature extending diametrically across said electromagnet with a first end portion above said supporting means and an opposite second end portion above said anvil means, pivot means at said first end portion pivotally mounting said armature on said supporting means for movement toward and away from said pole piece of said electromagnet, hammer means on said second end portion of said armature in position to strike said anvil means, said armature being movable about its pivot between a first position in which said hammer means engages said anvil means and a second position in which said hammer means is spaced from said anvil means, said armature being spaced from said pole piece in both of said positions, means biasing said armature in a direction from said first position to said second position, means limiting movement of said armature in said direction, and circuit means for periodically energizing said electromagnet at regular fractional-second intervals to attract said armature and thereby cause said hammer means on said second end of said armature to strike said anvil to generate said periodic mechanical tapping impulses, and means for fixing said base to said toner supplying means for conductively transmitting said periodic mechanical tapping impulses thereto.

2. A combination according to claim 1, in which said means limiting movement of the armature comprises a screw extending through a hole in the armature and screwed adjustably in a central tapped hole in said core, said screw having a head forming a stop for said armature.

3. A combination according to claim 2, in which said tapping means further comprises a ring of elastomeric material surrounding said screw below the head and engageable by said armature to prevent metal-to-metal contact between said armature and the head of said screw.

4. A combination according to claim 1, in which said anvil means comprises a protuberance projecting up from said base.

5. A combination according to claim 4, in which said base, anvil means and armature supporting means comprise a single metal stamping.

6. A combination according to claim 1, in which said armature supporting means comprises two posts projecting up from said base, said armature having said first end portion disposed between said posts, and in which said pivot means comprises a pin extending through aligned openings in said posts and armature.

7. A combination according to claim 6, in which said biasing means comprises a tension spring acting between said first end portion of said armature and a second pin extending between said posts.

8. A combination according to claim 1, in which a pad of firm elastomeric material between said armature and said anvil means prevents metal-to metal contact between said armature and said anvil.

9. A combination according to claim 8, in which said anvil means projects up from said base and said pad comprises a cap of elastomeric material fitting on the upper end of said anvil means.

10. A combination according to claim 1, in which the base of said tapping means is affixed to said toner dispensing means.

11. A combination according to claim 10, in which said toner dispensing means comprises a container for the toner having a restricted opening at the bottom of said container, a movable metering element controlling discharge of toner through said opening and means for intermittently moving said metering element to cause discharge of toner through said opening.

12. A combination according to claim 11, in which the base of said tapping means is affixed to said container.

13. A combination according to claim 1, in which said tapping means for generating periodic mechanical impulses has a frequency of 50 to 60 cycles per second.

14. A combination according to claim 1, comprising means for transmitting said periodic mechanical impulses to said reservoir and transporting means to improve the formation of an image by said toner on said plate.

15. A combination according to claim 1, comprising means controlling said tapping means to generate said periodicmechanical tapping impulses throughout the operation of said transporting means.

16. A combination according to claim 1, comprising means for adjusting the magnitude of said mechanical tapping impulses to a selected value between 1*g*. and 4*g*.

17. A combination according to claim 1, in which said container of said toner dispensing means has a restricted opening at the bottom thereof and said metering means comprises a grating at the bottom of said container and means for intermittently moving said grating in a horizontal direction, and in which said tapping means is disposed on said container in position to apply said periodic mechanical tapping impulses to said container in a horizontal direction.

18. A combination according to claim 17, in which said tapping means is disposed to apply said periodic mechanical tapping impulses to said container in a direction approximately perpendicular to the direction of movement of said grating.

19. A combination according to claim 1, in which said means for limiting movement of the armature comprises bracket means extending over the armature and adjustable abutment means on said bracket means forming a stop for said armature.

* * * * *